US011311086B2

(12) United States Patent
Van Geer

(10) Patent No.: US 11,311,086 B2
(45) Date of Patent: Apr. 26, 2022

(54) CREDIT CARD EJECTOR ADDRESSING SLIP STICK

(71) Applicant: René Johan Van Geer, Rijswijk (NL)

(72) Inventor: René Johan Van Geer, Rijswijk (NL)

(73) Assignee: R.J. VAN GEER BEHEER B.V., Rijswijk (NL)

( * ) Notice: Subject to any disclaimer, the term of this patent is extended or adjusted under 35 U.S.C. 154(b) by 661 days.

(21) Appl. No.: 16/303,554

(22) PCT Filed: May 26, 2017

(86) PCT No.: PCT/NL2017/050342
§ 371 (c)(1),
(2) Date: Nov. 20, 2018

(87) PCT Pub. No.: WO2017/204645
PCT Pub. Date: Nov. 30, 2017

(65) Prior Publication Data

US 2021/0219685 A1 Jul. 22, 2021

(30) Foreign Application Priority Data

May 26, 2016 (NL) ..... 2016843
May 25, 2017 (NL) ..... 2018979

(51) Int. Cl.
*A45C 11/18* (2006.01)

(52) U.S. Cl.
CPC ..... *A45C 11/182* (2013.01)

(58) Field of Classification Search
CPC ..... A45C 11/18; A34C 11/182; B65D 83/08
USPC ..... 150/147
See application file for complete search history.

(56) References Cited

U.S. PATENT DOCUMENTS

| | | | |
|---|---|---|---|
| 4,887,739 | A | 12/1989 | Parker |
| 5,718,329 | A | 2/1998 | Ippolito et al. |
| 8,899,411 | B2 | 12/2014 | Van Geer |
| 2002/0074246 | A1 | 6/2002 | Tiscione et al. |
| 2014/0014676 | A1 | 1/2014 | Minson et al. |
| 2015/0335118 | A1 | 11/2015 | Van Geer |

FOREIGN PATENT DOCUMENTS

| | | | |
|---|---|---|---|
| CH | 702919 | B1 | 10/2011 |
| CN | 204169237 | U | 2/2015 |
| EP | 0 287 532 | A2 | 10/1988 |
| JP | S60-179484 | U | 11/1985 |
| WO | 2010/0137975 | A2 | 12/2010 |
| WO | 2014/098580 | A1 | 6/2014 |

OTHER PUBLICATIONS

International Search Report and Written Opinion, dated Sep. 6, 2017, from corresponding PCT application No. PCT/NL2017/050342.

*Primary Examiner* — Sue A Weaver
(74) *Attorney, Agent, or Firm* — Nixon & Vanderhye

(57) ABSTRACT

Disclosed is a holder for cards, including a housing which tightly fits around a stack of cards and has a card opening for locating and removing cards. Within the housing a finger button operated ejector arm is provided such that the cards through the card opening can be partly slid from the housing. The ejector arm is designed such that a distal part of it further away from its rotation point is at an initial distance to the cards stack while a proximal part of it closer to its rotation point engages the cards stack and by further rotation of the ejector arm to its extended position the distal part starts engaging the cards stack due to cancelling of this distance.

18 Claims, 4 Drawing Sheets

CREDIT CARD EJECTOR ADDRESSING SLIP STICK

CROSS-REFERENCE TO RELATED APPLICATIONS

This application is a U.S. national stage application, filed under 35 U.S.C. § 371, of International Patent Application No. PCT/NL2017/050342 filed May 26, 2017, which designates the United States of America and which claims priority to NL 2018979 filed May 25, 2017 and NL 2016843 filed May 26, 2016.

BACKGROUND OF THE INVENTION

Field of the Invention

The invention relates to a card holder provided with a device (further also called "ejector") to eject or dispense the cards, e.g. credit cards or bank cards, or different flat or plate like objects, from the holder and wherein the card or cards tightly fit within the holder, for which the holder has a cavity similar to the shape and slightly bigger than the card or cards stack. The ejected cards are preferably presented as a staggered stack.

For the so called credit card format the main dimensions suffice ISO 7810 and the thickness and roundings suffice ISO 7813. This format is applied for many cards with a diversity of applications: bank cards, driving licenses, ID-cards, membership cards, entry tickets, reduction cards, savings cards, etc.

The cards preferably have a solid, not foldable shape and a smooth, slippery, low friction surface. The holder preferably has a rigid flat box or sleeve shape.

Description of Related Art

The prior art discloses in EP-A 0 287 532, CH702919 B1, WO2010137975 (VILT) and WO2014098580 (FLEXARM) a pivoting ejector arm provided with a stepped or relief profile along its length such that each card engages with a different edge at the ejector arm, the cards are simultaneously dispensed to present a staggered stack of cards, partly projecting out the card holder. Different card holders are disclosed in US2002/074246, U.S. Pat. Nos. 4,887,739, 5,718,329 and JP S60-179484 U.

The above cited prior art provides background knowledge for the present invention. The disclosure of this prior art is enclosed herein by reference.

BRIEF SUMMARY OF THE INVENTION

The object of the invention is versatile. In one aspect the object is a further improvement of the card holder, in particular of the feature to eject the stack of cards from the holder. By way of example, an object is a more elegant finger or thumb operation of the eject button during cards eject. Additional possible aspects are a comfortable, simple and accurate operation of the holder with long life. In yet another aspect the object is error free handling, low production costs, attractive appearance.

Thus the invention is directed to a card holder and to a card holder eject arm according to the claims. Other aspects can be learned from the specification, drawings or claims. Two or more aspects can be combined.

The inventor discovered that one of the effects of the invention is that the finger or thumb operating the eject button requires substantially less effort to eject the cards stack. This was found out by surprise during laboratory experiments, wherein one of the experimental eject arms showed unexpected low manual load requirements during cards ejecting. Subsequent thorough investigation pointed towards a unique spontaneous permanent deformation of the eject arm, possibly due to temporary malfunctioning of the laboratory injecting molding machine. This teaching was further elaborated and provided the basis for the present invention.

Without to be bound to the following explanation, a possible effect of the invention is as follows. With the prior art, the eject arm engages with a substantial length part, e.g. its complete length part provided with all the steps for ejecting a staggered cards stack, the entire cards stack. Thus, the cards are urged outward by a long lever arm. With the invention, initially the eject arm engages with a substantially smaller length part, e.g. only the length part closest to the pivot carrying one or two or only a minor number of steps, the entire cards stack or only a part of the cards stack. Thus, initially, the lever arm is short which keeps the required effort to start the outward movement of the cards low, although the rather high static friction needs be overcome. As soon as the cards move, the kinetic friction, substantially lower then the static friction, needs be overcome, such that the lever arm may lengthen (since steps further away from the pivot start engaging the cards) without negatively influencing the ergonomics experienced during finger or thumb operation of the eject button. Most elegant seems obtainable if during pivoting the eject arm towards the extended position, steps start engaging the cards one by one, preferably wherein each subsequent step is located at a longer lever arm.

In a preferred embodiment, the holder is provided with an eject arm designed such that during ejecting the cards by moving the eject arm to its extended position, first the eject arm engages and pushes outward the cards stack at a first eject arm longitudinal location close to its pivot while simultaneously the longitudinal part of the eject arm beyond said first location, seen from the pivot, does not engage and/or push the cards stack; and subsequently after the eject arm has covered an angle or distance while pushing the cards stack outward, the eject arm starts engaging and pushing outward the cards stack at a second eject arm longitudinal location further away from its pivot, preferably longitudinally spaced from the first location, while the eject arm continues pivoting toward its extended position. Preferably, the eject arm is designed such that there is a plurality, e.g. at least four or five or six, such locations along the eject arm length, preferably mutually longitudinally spaced, e.g. as many as there are contact faces for engagement with the individual cards of the stack for simultaneously ejecting a staggered stack, which locations are provided such that while the eject arm pivots toward its extended position and pushed the cards stack outward, said locations start pushing the cards stack the one after the other. Preferably a or all locations already pushing the cards stack continue pushing the cards stack when a next location starts pushing the cards stack; and/or each next location is further away from the eject arm pivot point. Preferably these locations are provided by the location of the contact faces.

In an embodiment the first location engages the complete cards stack and each next location engages a smaller part of the cards stack, preferably such that the location furthest away from the pivot engages merely a single card from the stack. Alternatively, preferably, the eject arm is designed such that from the time all locations engage and push the cards stack, each location engages a single card from the stack, e.g. such that the cards stack becomes or remains staggered.

Preferably, the part of the eject arm beyond the first location, viewed longitudinally from the pivot, equals in length or comprises at least 50% or 75% of the arm length provided with the contact faces. Preferably, the first location is provided at at least 25% or 30% or 40% and/or at the most 60% or 75% of the eject arm length, measured from the pivot.

Preferably, the locations are provided on a curved line, preferably with a single radius, e.g. circle, preferably of at least 100 or 150 or 200 millimeter. Alternatively, the locations are provided on a straight or stepped line. This line is e.g. provided by part of the leading edge of the eject arm, which is the edge that engages and pushes outward the cards stack. This line is one or more of: a virtual line; extends in longitudinal direction of the eject arm; nears toward the trailing edge of the eject arm viewed longitudinally from the pivot.

Preferably, viewed in the direction of pivoting of the arm from the retracted to the extended position, each next location or a group of locations or all locations is set back at least 0.05 or 0.075 millimeter relative to the adjacent location; or a location, e.g. the last (e.g. at the free end tip) location starting engaging and pushing the cards during pivoting of the eject arm, is set back at least 0.5 or 0.75, e.g. approximately 0.9, millimeter relative to the first (e.g. closest to the pivot) location starting engaging and pushing the cards.

This starting process of ejecting cards preferably is completed within a minor part, e.g. the first 25%, preferably 15% or 10%, of the movement or pivoting stroke of the eject arm from its retracted to its fully extended state and/or the outward movement stroke of the cards stack from completely within to maximally ejected by the eject arm. By way of example, it is e.g. completed within the first 10 or 20 degrees pivoting and/or the cards project outside the holder less then 5 or 10 or 15 millimeter. Preferably, completion requires at least 5% of said stroke, e.g. at least 5 degrees pivoting and/or at least 5 millimeter projection.

Preferably one or more of the following applies to the holder: a rectangular shape, preferably elongated; fixed shape, robust, of light weight material, e.g. metal or polymer material, polyester, PP; box or sleeve shaped; the card storage space receives a cards stack with tight fit; fixed length, width and depth; an ejector mechanism of the cards, preferably at the longitudinal end of the card holder opposite the card access opening to the housing space in which the cards are stored.

Preferably the invention is directed to a card holder provided with an ejector mechanism dispensing the complete stack of cards, thus all cards of the stack are dispensed simultaneously, e.g. since the ejector mechanism simultaneously engages the complete cards stack at the time of ejecting the cards. Preferably the cards are urged from the housing in such a manner that a staggered stack of cards, partly projecting out the card holder, is presented. This is preferably provided by the design of the ejector device. More preferably the design of the card holder or the ejector device is such that when the cards stack is completely contained within the card holder, the cards are mutually in register (in other words the cards are not staggered), and preferably is partly projected from the card holder, wherein the cards are presented in a staggered fashion. By presenting the cards in staggered fashion, they can be easily individually identified and individually taken from the stack by two fingers of the hand of the user. The card holder is preferably rigid in relation to the typical loads to which the card holder is exposed during normal daily use.

In particular the holder is designed to receive and dispense credit cards (and different items with dimensions comparable to credit cards, further mentioned as "cards"), preferably wherein a stack of, e.g. at least three, four or five, cards can be housed in the holder, more preferably wherein the cards in the stack are immediately mutually superposed or adjacent, in other words no further object, e.g. spacer, is or needs be present between adjacent cards. The holder preferably has two pairs of substantially or completely closed and fixed opposite sides, one pair with length and width almost equal to the same card dimensions (also called the "main sides") and this pair spaced by the other (also called the "minor sides") pair (delimiting the stack thickness) such that the card stack tightly fits between these four sides. Preferably these sides are thin walled and/or provide a rigid, sleeve like casing. Of the remaining pair of two opposite sides (typically located at the longitudinal ends of the sleeve) preferably one (also called the "bottom") is permanently substantially or completely closed and the other (also called the "top") is open but could be temporary closed, e.g. by a lid, such that the holder preferably has merely a single open side through which the cards can enter and exit the holder. Thus the holder provides a rigid sleeve with closed bottom. Typically the cards enter and exit the holder by moving parallel to their main sides.

To avoid that the cards can spontaneously leave the card holder, the device is preferably provided with card retaining means, e.g. a (preferably pivoting) removable lid associated with the access opening to open and close it, or clamping or friction means designed to engage e.g. a main side (a side defining a card face) or a minor side (a side defining the card thickness, i.e. the thin side) of the card. E.g. WO2010137975 (above cited) addresses releasably retaining the cards within the housing by friction means and the relevant disclosures are incorporated in here by reference. Retaining means to keep the cards within the holder without closing the top side with a lid, are preferred.

The ejector comprises an ejector element (further also called "arm") moving between a first and second (preferably a retracted and an extended, respectively) position inside the holder and engaging the cards stack, preferably engaging an edge of the cards, to push the cards stack out of the holder while the cards move in a plane parallel to their main faces, preferably such that the cards (with the ejector element in its extended position) partly project from the holder in a stepped or staggered manner. For the purpose of presenting or dispensing the cards in a stepped manner, the ejector arm is preferably provided with a relief profile, preferably having some relation with the thickness of the cards, such that the element has a plurality of spaced features, preferably located along a straight or curved line, e.g. lengthwise of the arm, each such feature designed to engage a single card from the stack, preferably such that by movement of the element within the holder, the one card is moving with the element for a further distance outward compared to another card from the same stack within the holder. In an embodiment such features are projections at the arm each providing an engagement edge (also called "face" or "contact face"), wherein preferably the projections project a different distance from the element such that each engagement face is present at a different level. Preferably the arm is designed such that, in its retracted position, the cards fit within the holder such that the cards are mutually in register, in other words, present a neat stack.

Preferably the height (meaning the dimension normal to the housing main sides and parallel to the thickness direction of the cards or cards stack loaded into the housing) of the ejector arm stepwise increases longitudinally from the free end (in other words the distal end or the end remote from the pivot point or the end opposite the end to which the drive means engage or are mounted). This stepwise increase of height provides step shaped features or contact faces for ejecting the cards stack in a staggered fashion.

The number of steps preferably at least equals the number of cards within the stack and/or is at least 4 or 5 or 6 or 7. The steps preferably have approximately equal longitudinal spacing and/or height.

In its extended position, the ejector arm preferably extends diagonally within the holder or makes an angle between 20 and 90 degrees (90 degrees equals a right angle), preferably at least 45 or 55 or 60 degrees and/or less than 85 degrees, compared to its retracted position. In its retracted position, the ejector arm preferably extends parallel to an external side (also called "bottom") or edge of the holder, preferably opposite the side from which the cards are dispensed from within the holder. Preferably the ejector arm rotates or swivels or turns or hinges or pivots between its first and second position, for which it is preferably provided with a hinge or pivot feature, such as a pin or hole, with which it is mounted to the holder, for which the holder can be provided with a hole or pin, respectively. In the alternative a translating movement is feasible.

To provide the movement of the ejector arm, the ejector comprises a drive means associated with the ejector arm. This could be a motoric means however a manually operated drive means, e.g. a finger operated button, is preferred, preferably projecting or located outside the housing. Preferably the ejector arm and the drive means are connected in a rigid manner such that the movement of the drive means is directly transferred to the ejector arm and both these members move as one, e.g. since both these members are integrated in a single, preferably rigid piece. The ejector arm and/or drive means could be injection moulded parts, e.g. of polymeric or plastic or equivalent material.

Preferably the ejector arm provides or is part of, a base or bottom of the holder, or part of it, preventing exit of the cards from the associated side of the holder.

The card ejector feature gives the user the opportunity to partly slide the card stack from the housing. This is a preferred operation before the user can select a card and remove it from the housing.

By the time the eject arm is in its extended position, the cards are partly slid from the housing as a staggered or stepped stack such that each card presents an outside the housing projecting, exposed narrow strip of its upper main side and by viewing these strips the user can see at a blink which cards are present in the holder. Also the user can easy and quick select within the cards stack the desired card and remove it by manually sliding the cards mutually in a direction equal to or opposite the direction in which the cards are slid from the housing from their stored position completely within the housing.

An embodiment of the card ejector feature of the invention comprises, among others, a step like element, which by the user relative to the housing, e.g. by means of rotation or translation, can be moved against the cards stack, wherein the individual steps of the step like element exert at the individual cards in the stack in the direction of the card opening a force, resulting that the card stack slides outward in stepped shape. The steps have a height which is measured parallel to the arm height and the card thickness and a spacing which is measured perpendicular to the height and which determines the degree wherein the cards slide mutually if they slide in stepped shape from the housing. Further preferred details of the step like element are provided by above cited WO2010137975 (VILT) and WO2014098580 (FLEXARM), the contents of which is inserted in here by reference.

An embodiment of the ejector, or part of it, e.g. the arm, as card remove feature of the card holder of the invention, is provided with or associated, e.g. coupled, with a reset means, e.g. a spring, with the effect that the ejector or the relevant part after operation will always immediately and automatically return to the initial position, e.g. move from the extended to the retracted position. Such by the reset means provided return offers the advantage such that without obstruction the user can slide cards back into the housing during making a selection from the partly exposed cards.

An embodiment of the card holder of the invention has a housing made of a galvanic material. The geometry of the housing of this invention lends itself for fabrication by means of metal extrusion, with which a proper Faraday cage is made.

BRIEF DESCRIPTION OF THE SEVERAL VIEWS OF THE DRAWINGS

The invention will now be further explained by way of the drawing, showing presently preferred embodiments. The drawing shows in:

FIG. 1-5 provide technical background.

FIG. 1-3 show a perspective view of the housing of the card holder which tightly fits around the shown stack of at least three cards (four are shown), wherein one of the two longitudinal ends of the housing is referred to as a card opening because it is opened to receive and remove cards. The tightly fit around the card stack implicates a main shape based on a right angled brick, but it can of course, for reasons of design or ergonomics, differ, e.g. by providing chamfers, roundings, ribs, etc.

DETAILED DESCRIPTION OF THE INVENTION

Figure 1:
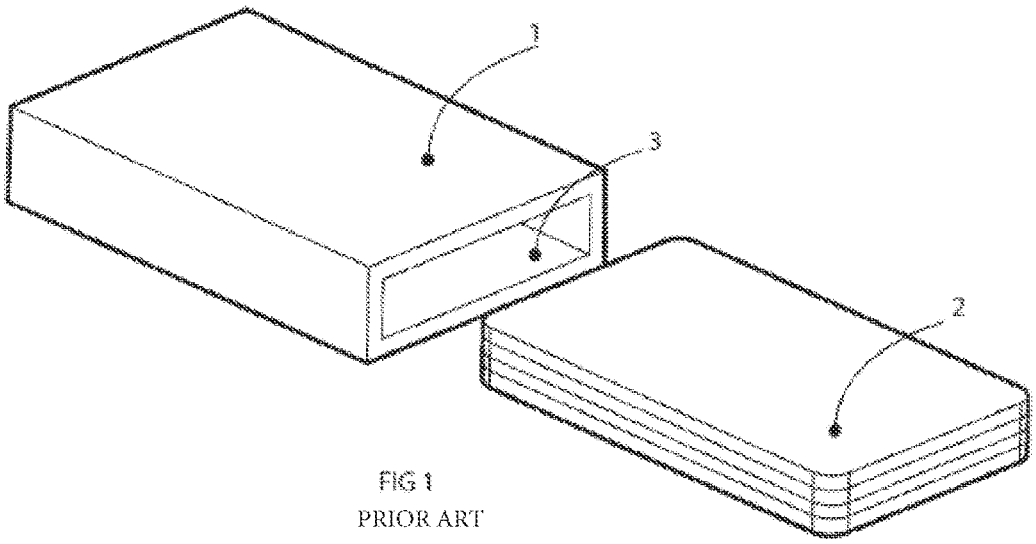
FIG 1 PRIOR ART
FIG. 1-2 a card holder, in perspective view.
Figure 2:
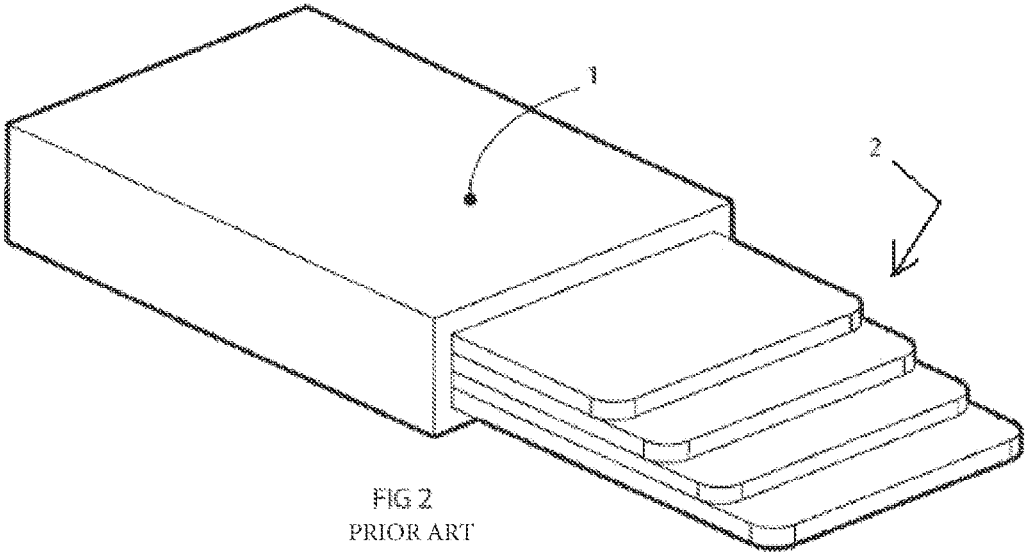
FIG 2 PRIOR ART

FIG. 1 shows the holder 1 and a neat stack 2 of four mutually registered cards, ready to be loaded into the holder through the cards opening 3. If completely located in the holder, the lower side of each card is in register with a relevant engagement or contact face of the ejector arm in its first (retracted) position. Starting from this position of the ejector arm and moving (pivoting) it to its second position, the cards will be forced by the associated engagement face such that the cards stack is partly ejected. Since each engagement face has a different distance to the pivot point of the ejector arm, each card will travel a different distance such that a staggered ejected stack 2 is obtained (shown in FIG. 2 in which the ejector arm (not shown) is in its second, extended, position), each card presenting an exposed narrow strip of a main side as shown.

Figure 3:
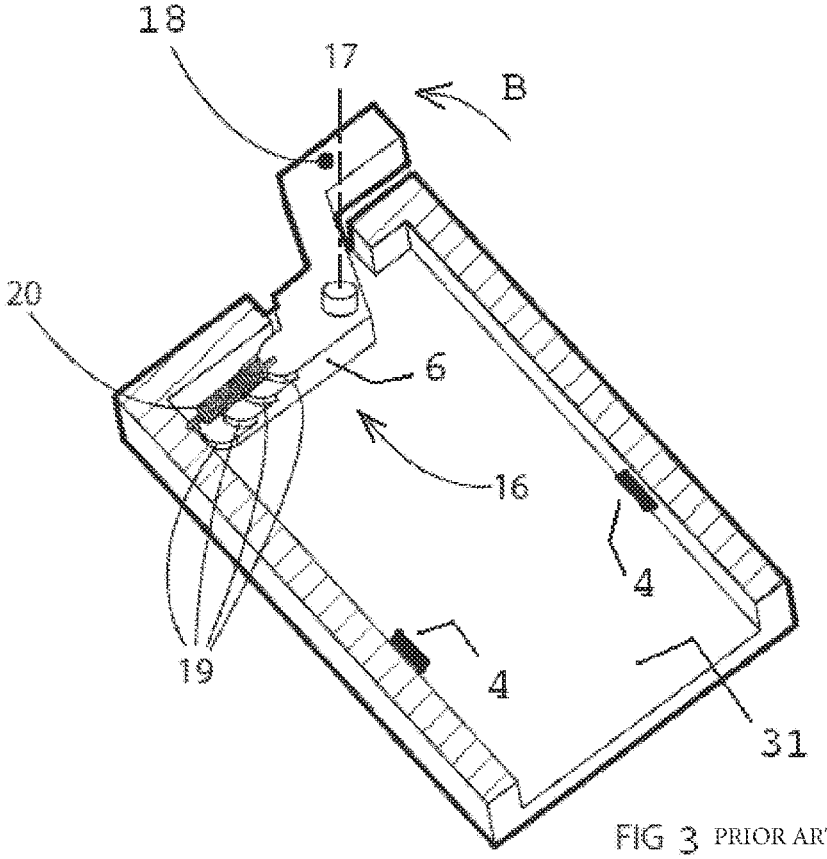
FIG 3 PRIOR ART
FIG. 3 a sectional view of the FIG. 1 card holder.

FIG. 3 shows in sectional view a holder (without cards) with a card eject feature (in the first (retracted) position) provided by the stepped element 16 which can pivot around an axis 17 if the user exerts in the pivot direction (according to the arrow B) a force through the actuator 18 outside the housing, which actuator 18 is rigidly connected to element 16, meaning a direct coupling. The stepped element 16, which is viewed from its top, is made from steps providing card contact faces 19 designed to exert force against the minor side of the cards to be ejected. The card contact faces 19 can be regarded as the bridges between two subsequent steps in the stepped shape and the height of these faces is equal to or smaller then the nominal card thickness (approx. 0.8 mm), whereby each face 19 contacts a different card. A reset spring 20 ensures that the ejector arm 16 after releasing the button 18 returns immediately and automatically to the initial (first) position shown. Friction elements 4, e.g. pads of rough fibre like material, e.g. felt, are located mutually opposite within the housing at the housing minor sides to engage each individual minor card side to retain the cards against gravity force.

FIG. 3 shows the connection between the button 18 and the ejector arm 16 extending through a passage in the bottom edge, meaning the edge opposite the opening 3. Alternatively such passage could be present in a side edge or even in a main side 31. The button 18 is shown adjacent the bottom edge, however could be located adjacent a side edge or even a main side 31. The bottom edge or side edge is a minor side, bridging the main sides 31. These locations of the passage and button 18 are known from the prior art.

FIG. 3 also indicates the leading edge 6 of the arm 16. The leading edge 6 is facing in the direction of movement from the retracted towards the extended state (direction of arrow B), and is designed to push the cards stack outside the holder.

Figure 4:
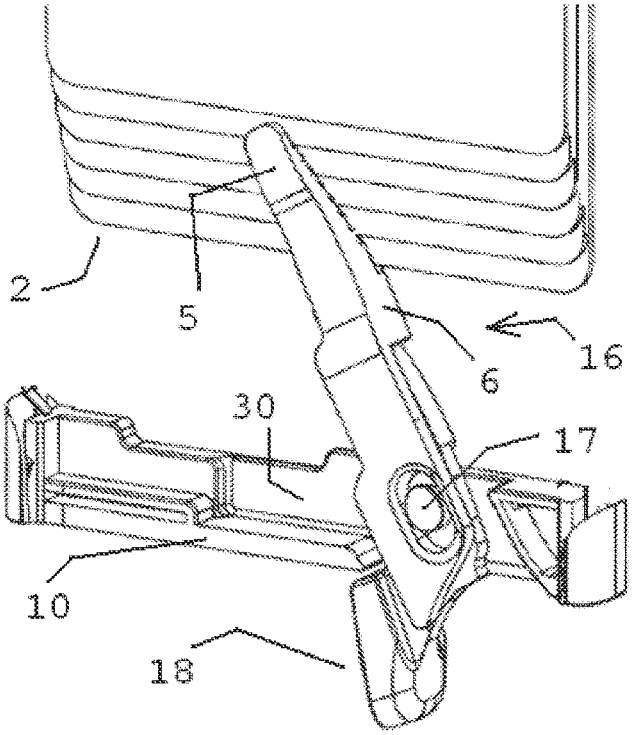
Fig. 4 PRIOR ART
FIG. 4 in perspective view a pivoted ejector arm engaging a staggered cards stack.

In FIG. 4, illustrating the bottom end of the holder 1, the housing is removed such that the eject elements within the housing are visible. The eject arm 16, which is viewed from its bottom, is pivoted to its second (extended) position, engaging the staggered cards stack 2 (only partly shown). Arm 16 is, by pivot 17, pivotably mounted to a fixture 10 which is fixedly located in the housing opening opposite the card opening 3, thus providing the bottom edge as a closure of the housing.

Figure 5:
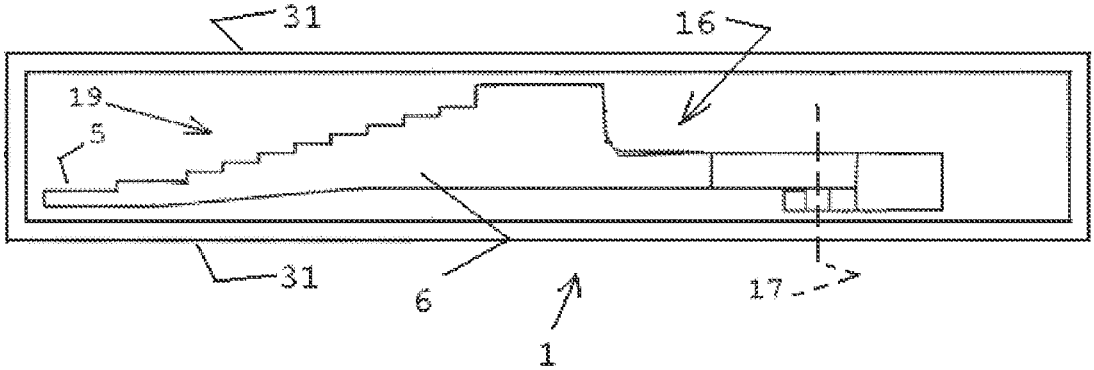
FIG. 5 an end view of the FIG. 1 card holder.

FIG. 5 is the view when looking into the holder 1 from the entrance 3 and illustrates in side view the eject arm 16 located between the main sides 31. The height of the eject arm 16 stepwise increases from the free end 5 towards the pivot 17 by the steps that provide the contact faces 19. In the FIG. 5 embodiment ten contact faces 19 are provided. The leading edge 6 faces towards the viewer of FIG. 5. The mutual spacing of the components shown in FIG. 7 is exaggerated for clarity.

As is clear from all FIG. 1-5, the height of the ejector arm 16 stepwise decreases from the proximal (close to the pivot point 17) to the distal (free or remote) end 5. The maximum ejector arm 16 height equals the height of the housing determined by the clearance between the two main sides 31 of the housing which equals the maximum thickness of a cards stack tightly fitting in the housing. The maximum ejector arm 16 height could be slightly smaller to allow movement of the arm 16 within the housing without undue friction with the inner faces of the opposite housing main sides 31 along which the top and bottom side, respectively, of the arm 16 slide.

The opposite main side walls 31 have smooth, level and flat inner faces, extending mutually parallel.

Figure 6:
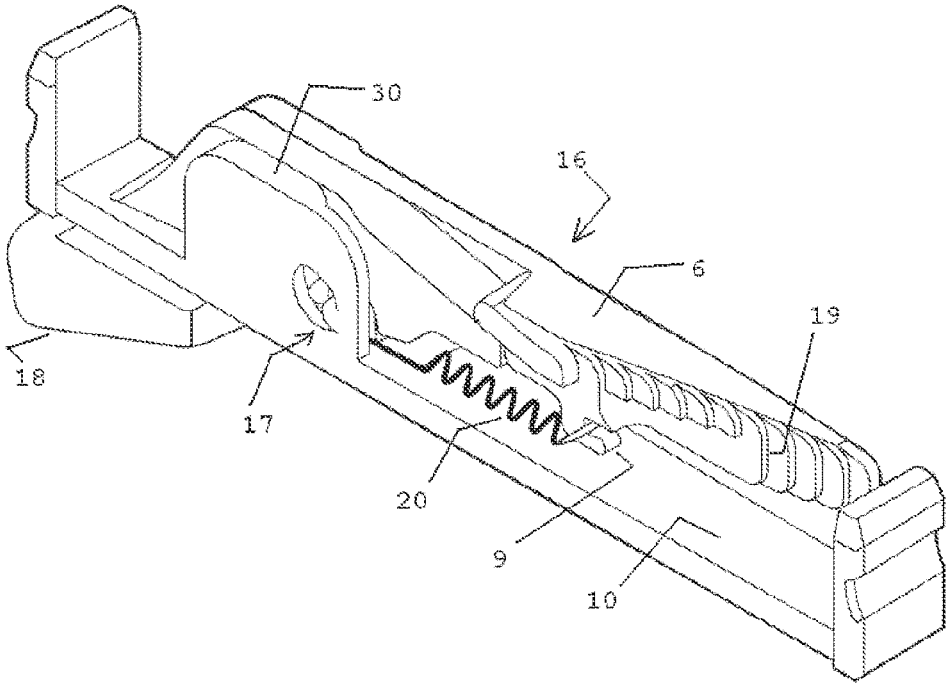
FIG. 6-7 in perspective view an ejector arm during different stages of its operation.
Figure 7:
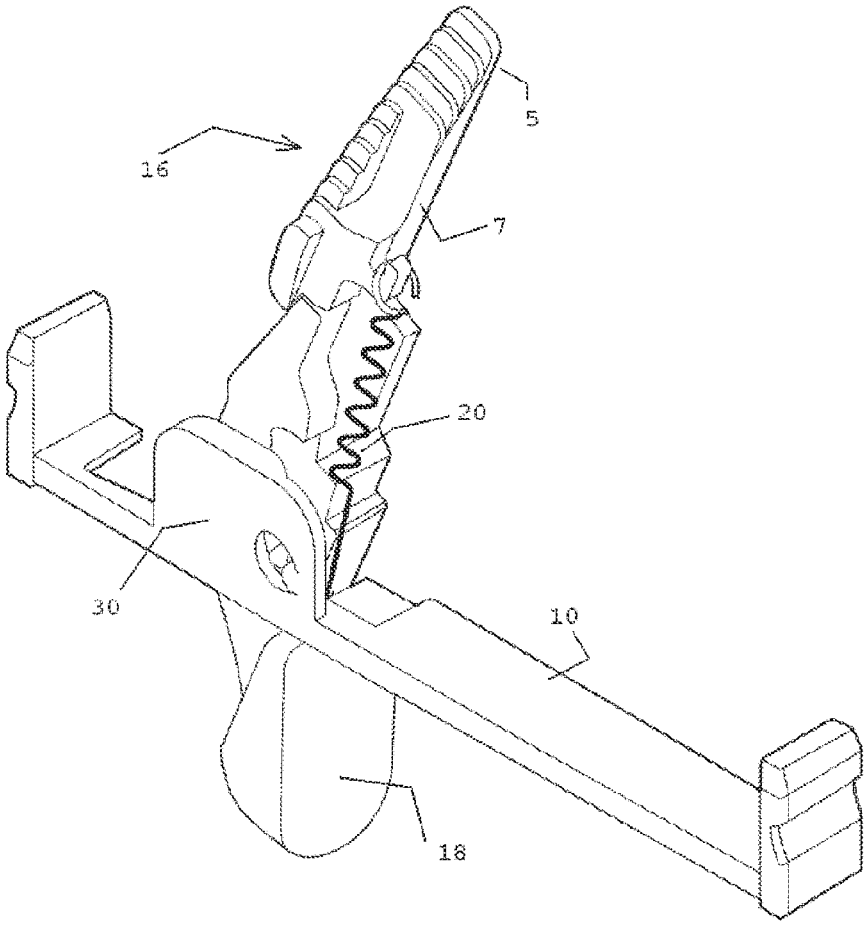

FIGS. 6 and 7 illustrate the eject arm 16 in its retracted (FIG. 6) and extended (FIG. 7) state, also illustrating the reset spring 20, the location 9 at which the spring 20 is mounted to the arm 16, and a by the fixture 10 provided upright wall 30 provided with a pivot feature 17 for hingedly mounting of the arm 16 to the fixture 10. The arm 16 is provided with twelve contact faces 19. FIG. 6 shows the leading edge 6, FIG. 7 the opposite trailing edge 7.

Figure 8:
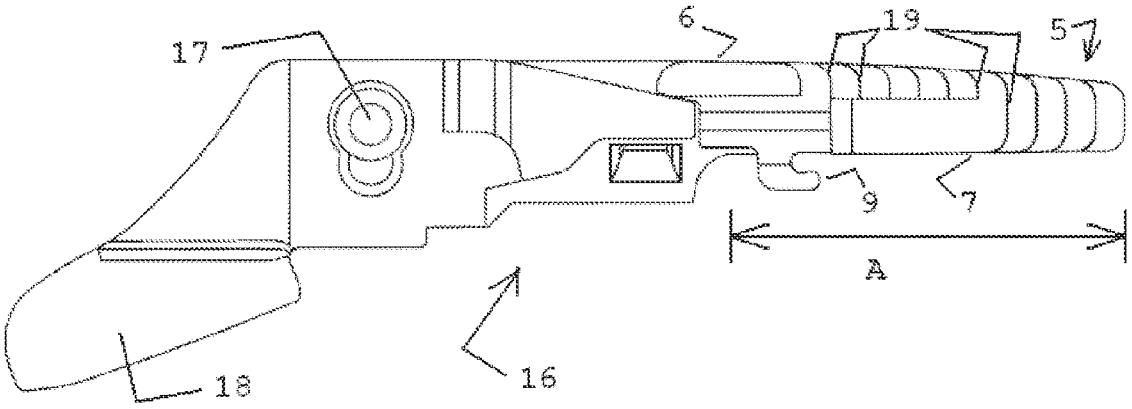
FIG. 8 a top view of the inventive ejector arm.

FIG. 8 shows a top view of arm 16 of FIGS. 4-7. The present invention is embodied in the area A of FIG. 8. This area A is detailed in FIGS. 9 and 10. The leading edge 6 tapers toward the trailing edge 7 in the arm longitudinal direction from the pivot 17 towards the free end 5.

Figure 9:
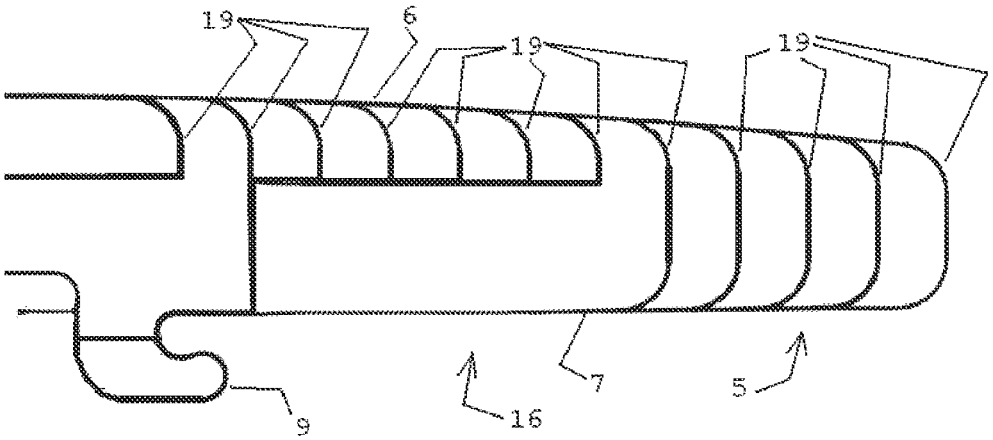
FIG. 9 a detail of FIG. 8.
Figure 10:
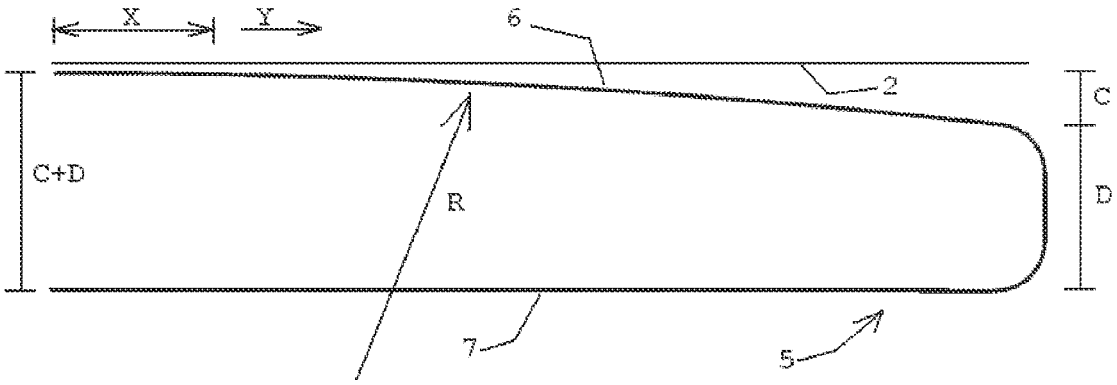
FIG. 10 a diagram to better understand FIG. 9.

FIG. 10 shows merely the outline of the in FIG. 9 illustrated part of arm 16 and the adjacent edge of the stack of cards in the mutual relation just prior to starting ejecting the cards (arm 16 in the retracted position, cards stacked in mutual register completely inside the housing). As shown, the width of the arm 16 starts at C+D (left hand side of the drawing) and, longitudinally along the arm toward the free end 5, continuously decreases to D, since the leading edge 6 follows a circular curved shape having radius R. The value of C is approximately 0.9 millimeter. This provides that, in the retracted state as FIG. 10 shows, the part of the leading edge 6 near free end 5 is more remote from the facing edge of the card 2 within the housing 1, compared to the part of the leading edge 6 further away from the free end 5. Thus, at the start of the pivoting movement of arm 16 towards the extended state, engagement of contact faces 19 adjacent free end 5 is delayed such that loading of arm 16 gradually increases while the arm 16 rotates to eject the cards, adding to a comfortable operation of the holder while ejecting the cards. Arm 16 starts pushing outward cards 2 in area X and, due to progressive pivoting of arm 16 toward its extended state, this area increases progressively in direction Y, such that after arm 16 is pivoted approximately 15% of the stroke toward its extended state, area X has arrived at the free end 5 tip. This means, if arm 16 starts pushing cards 2, merely contact face 19 most to the left in FIG. 9 pushes cards 2, and from then, due to progressive rotation of arm 16, each next contact face to the right in the drawing of FIG. 9 is engaged in the process of pushing outward the cards 2 and finally the free end 5 tip is engaged, after which arm 16 rotates further toward its extended state while each card 2 is engaged and pushed by a private contact face 19.

At the pivoting start of arm 16, the first contact face 19 (most to the left in FIG. 9) pushes all cards 2 of the stack simultaneously. Subsequently, as soon as the next face 19 to the right becomes engaged, the first contact face 19 merely pushes a single card (i.e. the first face 19 becomes the private face for this single card) and the next face 19 pushes the rest of the cards stack. Each time a next face 19 becomes engaged, this process of the previous face 19 becoming a private face 19 and the next face 19 pushing the remaining stack is repeated, until the remaining stack contains a single card.

It is appreciated that it is possible that a next face 19 is skipped or jumped by a card, e.g. depending on card thickness. Typically, the arm 16 is provided with more, e.g. at least two more, faces 19 compared to the maximum number of cards for which the holder is designed (typically six or seven cards), to take account of skipping of jumping a face 19 by a card.

The present invention can also be applied to a different arm. The number of contact faces 19 can be more or less then the number shown in the drawing. In an alternative embodiment an indirect coupling is applied between the arm 16 and the button 18, e.g. by a rod hingedly coupled to the arm 16 and/or the button 18. Many other alternatives are also feasible.

The drawing, the specification and claims contain many features in combination. The skilled person will consider these also individually and combine them to further embodiments. Also different embodiments belong to the invention. Features of different in here disclosed embodiments can in different manners be combined and different aspects of some features are regarded mutually exchangeable. All described or in the drawing disclosed features provide as such or in arbitrary combination the subject matter of the invention, also independent from their arrangement in the claims or their referral.

The invention claimed is:

1. A holder for cards, comprising:

a housing which tightly fits around a stack of at least three cards and has at least one card opening for locating and removing cards;

a card eject feature provided within the housing opposite the card opening such that the cards through the card opening can be partly slid from the housing, which card eject feature comprises an eject arm wherein the housing has two opposite main sides providing a mutual spacing defining the thickness direction of the cards stack and of the eject arm, and wherein the eject arm is mounted to the housing by a pivot feature and is designed to rotate, by the pivot feature, around a rotation point within the housing between and parallel to the main sides from a first, retracted position to a second, extended position and during said movement ejects the cards by engaging and forcing the cards simultaneously to partly exit the housing, wherein the cards stack has a minor side that defines the cards stack thickness and the eject arm has a free longitudinal end;

an external actuating feature, to provide the force to eject the cards by the eject arm and to drive the eject arm from the first to the second position, wherein the actuating feature is drivingly connected to the eject arm through coupling means, wherein the eject arm has a leading face that is facing towards the minor side of the cards stack within the housing and is facing in the direction in which the eject arm rotates from the first, retracted to the second, extended position, and the eject arm is designed such that, in the first position of the eject arm, a distal longitudinal part of the leading face of the eject arm, provided further away from the rotation point of the eject arm and closer to the free longitudinal end is set back from the minor side of the cards stack while at the same time a proximal longitudinal part of the leading face of the eject arm, provided closer to the rotation point of the eject arm and further away from the free longitudinal end has no distance to the minor side of the cards stack and engages and pushes the minor side of the cards stack such that the cards stack is initially ejected by only the proximal longitudinal part of the leading face of the eject arm for an initial distance and by further rotation of the eject arm from the first, retracted position to the second, extended position, the distal longitudinal part starts engaging and pushing the cards stack due to cancelling of this distance caused by the rotation of the eject arm such that the eject arm has covered an angle of rotation from the first, retracted position which causes the distal longitudinal part to progressively near the cards stack such that the cards stack is ejected for a further distance, beyond the initial distance, by the distal longitudinal part of the leading face of the eject arm, wherein the set back of the free-longitudinal end of the leading face is set at least 0.05 millimeter, viewed in the direction of rotating from the first to the second position by the eject area, relative to the proximal longitudinal part of the leading face of the eject arm, compared to the case when the leading face is provided such that at the free longitudinal end and at the proximal longitudinal part of the leading face of the eject arm the leading face simultaneously contacts and pushes the cards stack outward right from the start of rotating of the eject arm from the first, retracted position to the second, extended position, and wherein the proximal longitudinal part of the leading face is provided between 25% and 60% of the eject arm length, measured from the pivot feature.

2. Holder according to claim 1, wherein the initial distance between the distal longitudinal part of the leading face of the eject arm and the cards stack measures at least 0.25 millimeter.

3. Holder according to claim 1, wherein the angle of rotation that is covered by the eject arm from the first, retracted position to cancel the distance of the distal longitudinal part of the leading face to the cards stack is at least 5 degrees.

4. Holder according to claim 1, wherein the eject arm has a trailing face opposite the leading face, which trailing face is facing in the direction in which the eject arm rotates from the second, extended position to the first, retracted position, and wherein the leading face tapers towards the trailing face in the direction from the pivot feature to the free longitudinal end of the eject arm.

5. Holder according to claim 4, wherein the leading face tapers towards the trailing face according to a circular shape or a straight line.

6. Holder according to claim 1, wherein the eject arm is designed such that during ejecting the cards by moving the eject arm from its first, retracted position to its second, extended position, first the leading face of the eject arm engages and pushes outward the cards stack at a first longitudinal location of the leading face close to the pivot feature and being part of the proximal longitudinal part of the leading face of the eject arm while simultaneously the distal longitudinal part of the leading face of the eject arm located beyond, seen longitudinally along the eject arm from the pivot feature, said first location and extending from said first location to the free longitudinal end of the eject arm and including said free longitudinal end, has a distance to and does not engage and push the cards stack, and subsequently after the eject arm has covered an angle of rotation while rotating towards the second position while pushing the cards stack outward, the leading face of the eject arm starts engaging and pushing outward the cards stack at a second longitudinal location of the leading face, longitudinally of the eject arm further away from the pivot feature, and longitudinally spaced from the first location and located in said distal longitudinal part of the leading face of the eject arm.

7. Holder according to claim 6 wherein the first longitudinal location of the leading face engages and pushes the complete cards stack, in other words engages and pushes all cards of the stack, and the second longitudinal location of the leading face engages and pushes merely a single card from the stack.

8. Holder according to claim 1, wherein the eject arm has a stepwise increase of thickness longitudinally from the free longitudinal end of the eject arm, which stepwise increase of thickness provides a leading face having step shaped contact faces, each having a different distance to the pivot feature, viewed longitudinally of the eject arm, which step shaped contact faces during ejecting the cards by the eject arm engage and push the cards stack such that the cards stack is ejected in a staggered fashion and each step shaped contact face is provided such that while the eject arm rotates from its first, retracted position toward its second, extended position and contacts and pushes the cards stack outward, said step shaped contact faces start engaging and pushing the cards stack in sequence the one after the other which sequence progresses in the direction towards the free longitudinal end of the eject arm such that first the step shaped contact face most proximal from the pivot feature and finally the step shaped contact face most distal from the pivot feature comes in engagement with a card of the cards stack and pushes it because, viewed longitudinally of the eject arm from the pivot feature, each subsequent step shaped contact face is set back at least 0.05 millimeter, viewed in the direction of rotating from the first to the second position by the eject arm, relative to the previous step shaped contact face, compared to the case when all step shaped contact faces are in line to simultaneously contact and push the cards stack right from the start of rotating of the eject arm from the first, retracted position to the second, extended position.

9. Holder according to claim 8, wherein the eject arm is designed such that at the start of ejecting the cards stack by the eject arm, cards are pushed and engaged by a shared step shaped contact face of the eject arm which shared step shaped contact face ejects the cards of the stack simultaneously and, after some rotation of the eject arm towards the second position, said cards are pushed further outward by a relevant private step shaped contact face such that after said some rotation of the eject arm each card is pushed outward by an own step shaped contact face, providing the partly ejected cards stack a staggered shape.

10. Holder according to claim 8, wherein the distal longitudinal part of the leading face of the eject arm comprises at least 50% of the length part of the eject arm that is provided with the step shaped contact faces.

11. Holder according to claim 8, wherein the step shaped contact faces are provided on a curved line.

12. Holder according to claim 11, wherein the curved line is provided by a single radius of at least 100 millimeter.

13. Holder according to claim 8, wherein the step shaped contact faces are provided on a straight line.

14. Holder according to claim 8, the eject arm is designed such that when the eject arm has rotated towards its second, extended position such that all step shaped contact faces engage and push the cards stack, each step shaped contact face engages a single card from the stack providing that the cards stack becomes or remains staggered.

15. Holder according to claim 1, wherein the actuating feature, projects outside the housing and wherein the eject arm and the actuating feature are connected in a rigid manner such that the movement of the actuating feature is directly transferred to the eject arm and both these members move as one since both these members are integrated in a single, rigid piece.

16. A holder for cards, comprising:

a housing which tightly fits around a stack of at least three cards and has at least one card opening for locating and removing cards;

a card eject feature is provided within the housing opposite the card opening such that the cards through the card opening can be partly slid from the housing, which card eject feature comprises an eject arm wherein the housing has two opposite main sides providing a mutual spacing defining the thickness direction of the cards stack and of the eject arm, and wherein the eject arm is mounted to the housing by a pivot feature and is designed to rotate, by the pivot feature, around a rotation point within the housing between and parallel to the main sides from a first, retracted position to a second, extended position and during said movement ejects the cards by engaging and forcing the cards simultaneously to partly exit the housing, wherein the cards stack has a minor side that defines the cards stack thickness and the eject arm has a free longitudinal end;

an external actuating feature, to provide the force to eject the cards by the eject arm and to drive the eject arm from the first to the second position, wherein the actuating feature is drivingly connected to the eject arm through coupling means, wherein the eject arm has a leading face that is facing towards the minor side of the cards stack within the housing and is facing in the direction in which the eject arm rotates from the first, retracted to the second, extended position and the eject arm is designed such that, in the first position of the eject arm, a distal longitudinal part of the leading face of the eject arm, provided further away from the rotation point of the eject arm and closer to the free longitudinal end is at an initial distance of at least 0.05 millimeter to the minor side of the cards stack while at the same time a proximal longitudinal part of the leading face of the eject arm, provided closer to the rotation point of the eject arm and further away from the free longitudinal end has no distance to the minor side of the cards stack and engages and pushes the minor side of the cards stack such that the cards stack is initially ejected by only the proximal longitudinal part of the leading face of the eject arm for an initial distance and by further rotation of the eject arm from the first, retracted position to the second, extended position, the distal longitudinal part starts engaging and pushing the cards stack due to cancelling of this distance caused by the rotation of the eject arm such that the eject arm has covered an angle of rotation from the first, retracted position which causes the distal longitudinal part to progressively near the cards stack such that the cards stack is ejected for a further distance, beyond the initial distance, by the distal longitudinal part of the leading face of the eject arm, wherein at the inner side of the housing a friction element is located which exerts a friction force to the side edge of each individual card within the housing to retain the cards against gravity force, which friction element is of sufficient dimension to simultaneously engage all cards in the stack and is not rigid;

and the cards receiving space is sleeve or shaft like;

and the receiving space is designed such that the cards through the card opening parallel to their top face must be slid from this space;

the eject arm is coupled with a reset means, with the effect that the eject arm after rotation towards the second position will always immediately and automatically return to the first position;

the eject arm has a stepwise increase of thickness longitudinally from the free longitudinal end of the eject arm that provides the leading face with step shaped contact faces for ejecting the cards stack in a staggered fashion and the eject arm is designed to simultaneously engage and eject the complete cards stack;

the eject arm is designed such that during ejecting the cards by moving the eject arm to its extended position, first the leading face of the eject arm engages and pushes outward the cards stack at a first longitudinal location close to its pivot feature, which location is part of the proximal longitudinal part of the leading face of the eject arm, while simultaneously the longitudinal part of the leading face of the eject arm beyond said first location, seen from the pivot, which part is provided by the distal longitudinal part of the leading face of the eject arm, does not engage and push the cards stack; and subsequently after the eject arm has rotated an angle while pushing the cards stack outward, the eject arm starts engaging and pushing outward the cards stack at a second longitudinal location of the leading face of the eject arm further away from its pivot feature, and longitudinally spaced from the first location and provided by the distal longitudinal part of the leading face of the eject arm, while the eject arm continues pivoting toward its extended position;

and wherein the proximal longitudinal part of the leading face is provided between 25% and 60% of the eject arm length, measured from the pivot feature, and wherein the distal longitudinal part of the leading face of the eject arm comprises at least 50% of the length part of the eject arm that is provided with the step shaped contact faces.

17. Holder according to claim 16, wherein the eject arm is designed such that starting from the completely retracted position and moving towards the completely extended position, first merely the step shaped contact face closest to the pivot feature comes in engagement with a card of the cards stack and during continued movement towards the completely extended position the other step shaped contact faces further away from the pivot feature, mutually spaced along the eject arm length, come in engagement with a card of the cards stack one after the other in the direction of the free longitudinal end of the eject arm during progressive rotation of the eject arm, such that finally the step shaped contact face most distal from the pivot feature comes in engagement with a card of the cards stack.

18. A holder for cards, comprising a housing which tightly fits around a stack of at least three cards and has at least one card opening for locating and removing cards, while within the housing, opposite the card opening, a card eject feature is provided such that the cards through the card opening can be partly slid from the housing, which card eject feature comprises an ejector arm which is designed to eject the cards by engaging and forcing the cards simultaneously to partly exit the housing, during rotating within the housing between a retracted and an extended position, the ejector arm is provided with a leading edge corresponding to contact faces for initial engagement with the cards during ejecting the cards and the holder comprises an external actuating feature to provide the force to eject the cards by the card eject feature, which actuating feature is drivingly connected to the ejector arm through coupling means, wherein, viewed in the direction of rotating of the ejector arm from the retracted to the extended position, the part of the leading edge corresponding to each next contact face or a group of contact faces or all contact faces for initial engagement with the cards is set back at least 0.05 or 0.075 millimeter relative to part of the leading edge corresponding to the adjacent contact face for initial engagement with the cards.

* * * * *